US005914648A

United States Patent [19]

Caddock, Jr.

[11] Patent Number: 5,914,648

[45] **Date of Patent: *Jun. 22, 1999**

[54] FAULT CURRENT FUSING RESISTOR AND METHOD

[75] Inventor: Richard E. Caddock, Jr., Winchester, Oreg.

[73] Assignee: Caddock Electronics, Inc., Roseburg, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,813

[22] Filed: Feb. 12, 1996

Related U.S. Application Data

[63] Continuation-in-part of application No. 08/400,046, Mar. 7, 1995, abandoned.

[51] Int. Cl.[6] ..... H01H 85/143

[52] U.S. Cl. ..... 337/252; 337/227

[58] Field of Search ..... 337/252, 186.7, 337/227, 228, 238, 232, 297; 29/623, 411

[56] References Cited

U.S. PATENT DOCUMENTS

| | | | |
|---|---|---|---|
| 3,401,452 | 9/1968 | Ragan . | |
| 3,555,365 | 1/1971 | Forlani et al. . | |
| 3,978,443 | 8/1976 | Dennis et al. . | |
| 4,093,932 | 6/1978 | Kozacka . | |
| 4,626,818 | 12/1986 | Hilgers . | |
| 4,771,260 | 9/1988 | Gurevich . | |
| 5,027,101 | 6/1991 | Morrill, Jr. . | |
| 5,032,817 | 7/1991 | Morrill, Jr. et al. . | |
| 5,097,246 | 3/1992 | Cook et al. . | |
| 5,140,295 | 8/1992 | Vermot-Gaud et al. . | |
| 5,166,656 | 11/1992 | Badihi et al. . | |
| 5,228,188 | 7/1993 | Badihi et al. . | |
| 5,252,944 | 10/1993 | Caddock, Jr. . | |
| 5,254,969 | 10/1993 | Caddock, Jr. | 337/297 |
| 5,291,178 | 3/1994 | Strief et al. . | |
| 5,296,833 | 3/1994 | Breen et al. . | |
| 5,304,977 | 4/1994 | Caddock, Jr. . | |
| 5,361,300 | 11/1994 | Caddock, Jr. . | |
| 5,363,082 | 11/1994 | Gurevich . | |
| 5,440,802 | 8/1995 | Whitney et al. | 337/297 |
| 5,453,726 | 9/1995 | Montgomery . | |
| 5,479,147 | 12/1995 | Montgomery . | |
| 5,481,242 | 1/1996 | Caddock, Jr. . | |
| 5,581,227 | 12/1996 | Drekmeier . | |
| 5,594,407 | 1/1997 | Caddock, Jr. . | |
| 5,621,378 | 4/1997 | Caddock, Jr. et al. . | |
| 5,633,620 | 5/1997 | Doerrwaechter . | |

FOREIGN PATENT DOCUMENTS

| | | |
|---|---|---|
| 0 581 428 A1 | 2/1994 | European Pat. Off. . |
| 0 626 714 A1 | 11/1994 | European Pat. Off. . |
| 0665560A2 | 12/1994 | European Pat. Off. . |
| 2944605A1 | 11/1979 | Germany . |
| 3245629A1 | 12/1982 | Germany . |
| 41 14 495 A1 | 7/1991 | Germany . |
| Hei 2-175574 | 7/1990 | Japan . |
| Hei 4-902480 | 11/1992 | Japan . |
| 5144368 | 6/1993 | Japan . |
| Hei 5144368 | 6/1993 | Japan . |
| 5274994 | 10/1993 | Japan . |
| Hei 5274994 | 10/1993 | Japan . |
| 1749943A1 | 7/1990 | U.S.S.R. . |
| 2 225 455 | 11/1992 | United Kingdom . |

*Primary Examiner*—Lincoln Donovan
*Attorney, Agent, or Firm*—Oppenheimer Wolff & Donnelly LLP

[57] ABSTRACT

A fault current fusing resistor, comprising a substrate on which there is a line of resistive film formed of metal and glass in a conductive film, which line is closely confined by containing and sealing substances to prevent venting of vapor from the line during the fusing caused by an electrical fault condition.

46 Claims, 4 Drawing Sheets

FIG. 7.
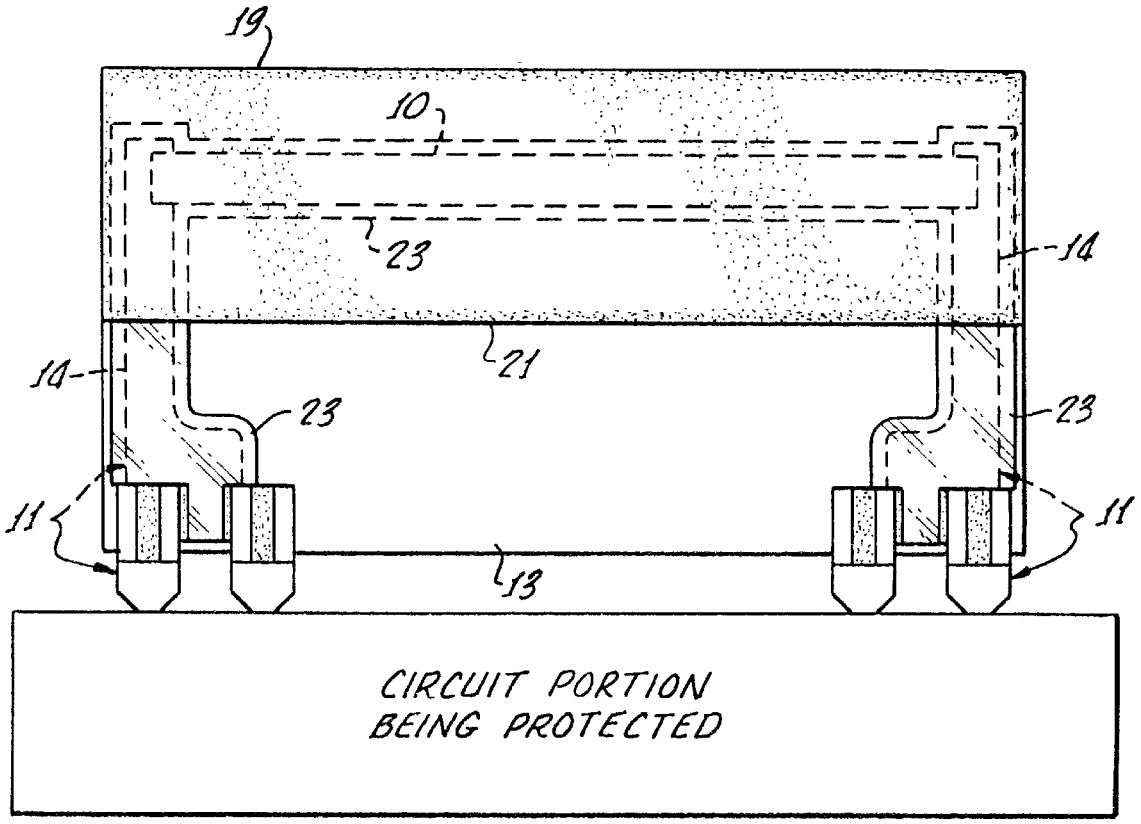
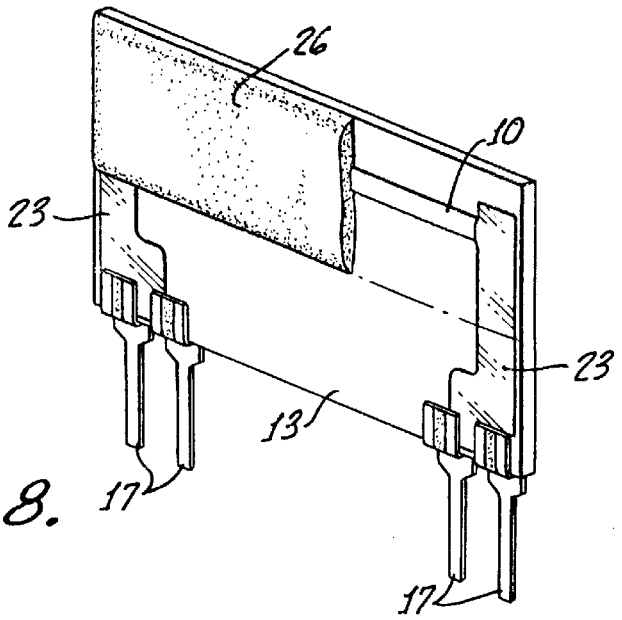
FIG. 8.

FAULT CURRENT FUSING RESISTOR AND METHOD

CROSS REFERENCE TO RELATED APPLICATION

This is a continuation-in-part of application Ser. No. 08/400,046, filed Mar. 7, 1995 abandoned, for Fault Current Fusing Resistor and Method.

BACKGROUND OF THE INVENTION

There is, in a number of industries and applications, a major need for a fault current fusing resistor that is very fast opening for relatively high currents and high AC and DC voltages. There is an even greater need for such a fault current fusing resistor that is inexpensive to manufacture and small in size, and that is characterized by a high degree of safety.

To state one example, there are power system applications where power-semiconductors (transistors, thyristors, SCRs etc.) are used in circuits which manage large currents at relatively high DC voltages. An illustration is the power drivers for motors such as are used on electric trains. The power-semiconductors associated with the control circuits or drive circuits occasionally short internally, which can cause the portion of the circuit that is in the short circuit path caused by the shorted power-semiconductor to be exposed suddenly to a very high fault current and fault voltage.

The preceding paragraph sets forth one example of a fault current condition, which is not a gradual or progressive current buildup to an excessive value, but instead a sudden large step or jump in current from normal to excessive. "Normal" is the current level present in the portion of the power-semiconductor circuit to be protected (potential short circuit path) against fault current during normal operation; it is a low current typically from a few milliamps to 2 amps. "Excessive" is what is present in the short circuit current path substantially immediately upon occurrence of the short, being the high fault current that is typically in excess of 15 amps, and more typically 50 amps to 500 amps or greater—with a voltage typically in excess of 125 volts up to 1,000 volts or higher.

It is badly needed to have an economical, fast-acting, fusing device that operates at those and other relatively high (excessive) fault currents and high voltages. Fast operation would effectively protect circuit board traces, and components, in the short circuit current path.

Insofar as applicant is presently informed, fault current fusing devices which operate at relatively high currents and that can interrupt at relatively high voltages are quite large, and/or expensive, and/or slow-acting, and/or have other disadvantages.

SUMMARY OF THE INVENTION

In accordance with the device and method of the invention, there is provided a fault current fusing resistor (FCFR) that operates very quickly when exposed to the described (and other) relatively high fault currents and relatively high fault AC/DC voltages. The device opens (clears) in a way that is controlled, contained, and nonexplosive, thus substantially safe, and that does not generate debris. There is substantially no uncontained arcing, or no arcing at all.

In accordance with a method of the invention, the stated article or device is placed in a power-semiconductor circuit, or the like, and operates for great periods of time with only the normal low current passing through it. However, upon sudden occurrence of a fault current, the step change in current flow results in the stated very fast cessation of flow of the fault current.

In accordance with a preferred embodiment of the device, a relatively low value elongate resistive element (not a wire) is sandwiched between a base and a lid, and sealed therebetween as by epoxy. The resistive element within the sealed device has such characteristics that upon occurrence of a fault current flow, such current flow very quickly ceases which includes the necessary interruption at the fault voltage.

In accordance with the method and article of the invention, metal, preferably mixed with glass in a conductive film, is employed in a novel manner producing startling results.

The preferred resistive element is a resistive film provided on the base (substrate), and the film has a relatively low resistance.

The resistive film has deposited there over an overglaze (or equivalent) film.

Terminals and traces are provided on the substrate for the resistive film. In one embodiment, the terminals and substrate and traces are so disposed and related as to insure against excessive heating of the terminals (and the related circuit board portion) during normal current conditions.

BRIEF DESCRIPTION OF THE DRAWINGS

FIG. 7 shows the combination of FCFR and circuit portion being protected, the latter being represented diagrammatically in block form;

FIG. 8 is an isometric view of another embodiment of the invention, portions being broken away;

DETAILED DESCRIPTION OF THE PREFERRED EMBODIMENT

Figure 1:
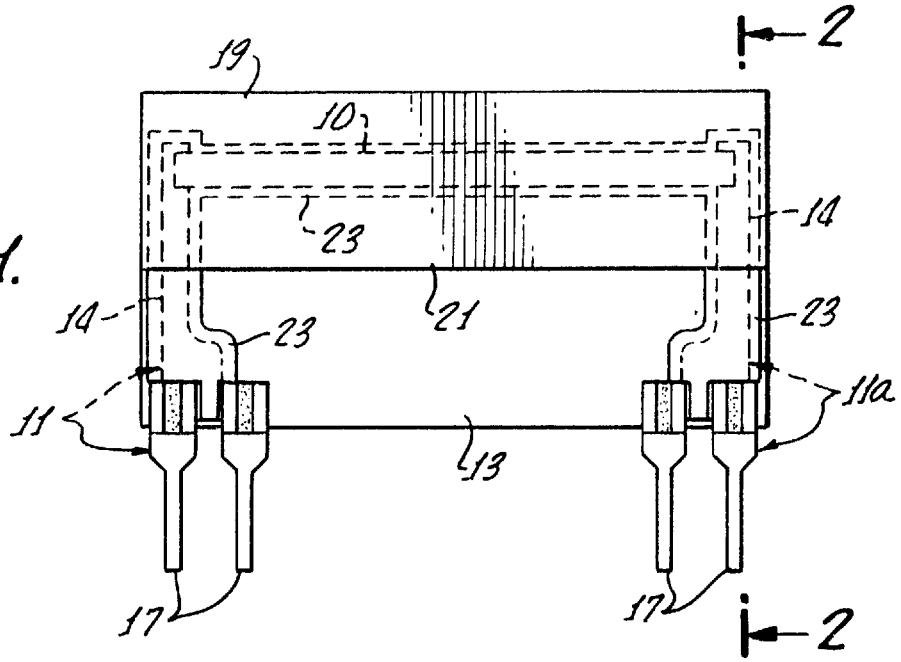
FIG. 1 is a greatly enlarged plan view of an FCFR embodying the present invention.
Figure 5:
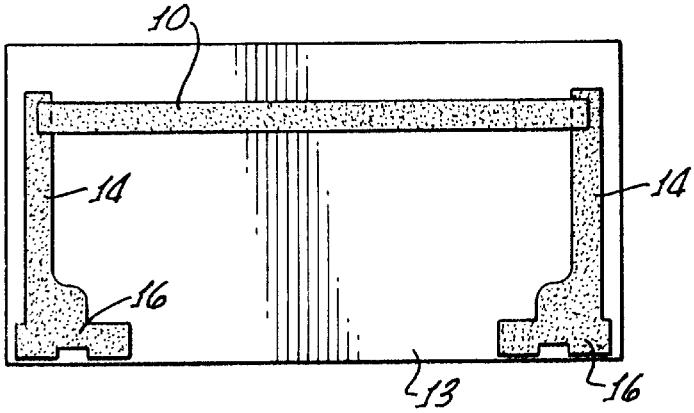
FIG. 5 shows the resistive film as applied to the substrate.
Figure 6:
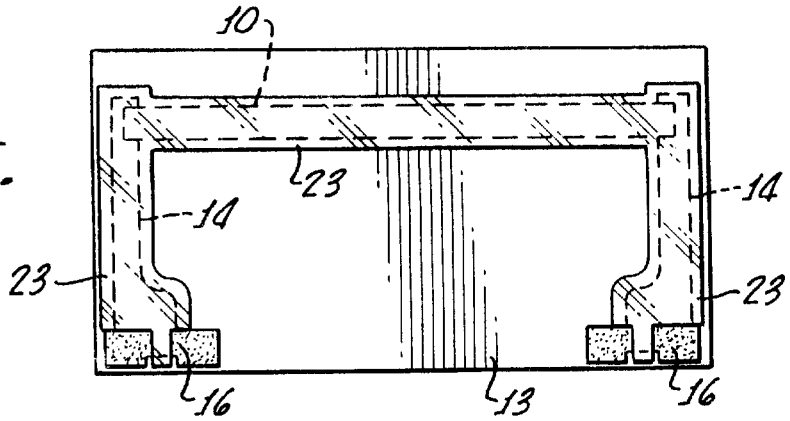
FIG. 6 shows the glass coating as applied over the films at all portions except terminal pad regions.
Figure 9:
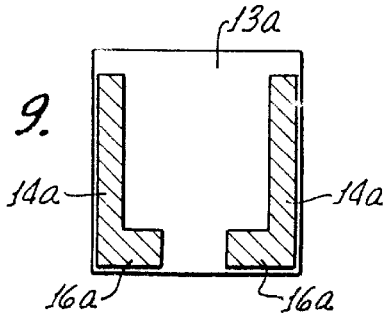
FIGS. 9–14, inclusive, are front elevational views of steps incident to the production of an additional embodiment.
Figure 10:
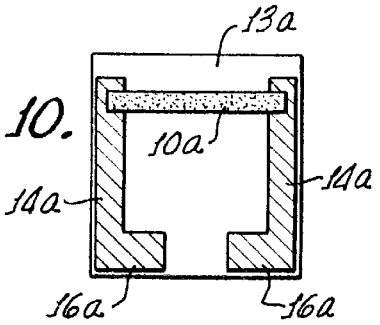
Figure 11:
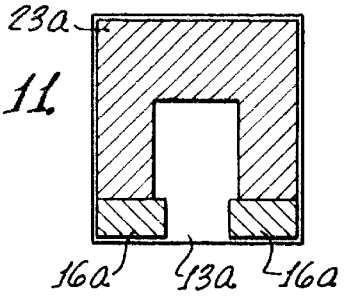
Figure 12:
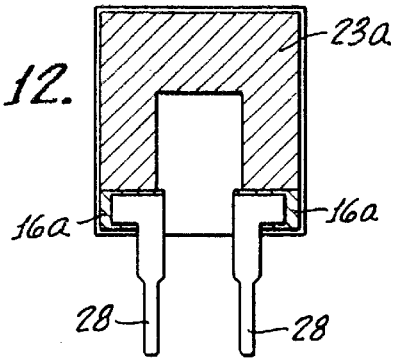

Referring particularly to FIGS. 1, 5 and 6, an elongate resistive element 10 is extended between terminal means 11, 11*a* (FIG. 1). The element 10 is contained and sealed-in by containing and sealing means 12 (FIG. 2) that are sufficiently strong to withstand the forces related to the heating and opening of the resistive element caused by fault current.

Resistive element 10 is preferably a screen-printed resistive thick-film composition on a base or substrate 13, the latter also forming part of the containing and sealing means described below. Alternatively, the resistive element 10 may be formed by vacuum deposition, sputtered deposition, "inkjet", or other similar means.

Preferably, the thick-film screen-printed element 10 is a palladium-silver composition. Preferably, the element 10 is screen-printed thin, using a 325 or 400 mesh screen. An example of the palladium-silver compositions that may be employed is "Ferro 850" series, sold by Ferro Corporation, Electronic Materials Division, Santa Barbara, Calif.

The composition and shape of the resistive element 10 are such that it has a relatively low resistance of usually under 30 ohms, preferably 10 ohms down to 1.0 or 0.5 ohm (or even somewhat lower). The resistance of resistive element 10 is not down to a small fraction of an ohm, for example, a few milliohms. The resistivity of the material forming the resistive element 10 is typically in the fractional ohms per square.

Relative to the length of the resistive line 10, this is made sufficiently long to withstand the applied voltage after the fault current has ceased, but sufficiently short to prevent the resistance from being excessively high and sufficiently short for proper operation. A line length of less than 1 inch is preferred. The lower the voltage rating of the device, the shorter the line length necessary for proper operation.

Relative to the width of the resistive line 10, the narrower lines are preferred insofar as operation during a fault is concerned. Thus, vis-a-vis FCFR action, a 0.01 inch line width is preferred over the 0.03 inch line width. However, during normal (pre-fault) operation, the wider (e.g. 0.03 inch) line spreads the power over a greater surface area and aids in heat dissipation. Thus, for example, (referring to resistive line 10) when normal power in the FCFR is a fraction of a watt, a narrower line such as the 0.01 inch wide line is preferred. When normal power is 1 watt or more, a wider line such as the 0.03 inch wide line is preferred.

The lower resistance values specified above—e.g., 1 ohm—require less power dissipation in the FCFR caused by normal mode lower level currents in (for example) the power-semiconductor circuit in which the FCFR is connected. Higher resistance values (such as 10 ohms) in the range specified in the preceding paragraph limit the magnitude of the fault current during the moment just before the FCFR opens.

Configurations that may be employed include arcuate and meandering, provided there is a shallow angle that avoids a small dimension between adjacent lines in the meandering pattern so that there will not be arcing between loops.

A straight line is preferred. The line may also be arcuate (as stated) or a wide angle that is preferably obtuse. The line (forming element 10) should progress forwardly (toward the opposite terminal) instead of doubling back. In any event, there may be no doubling back where different parts of the adjacent lines are so close together as to cause arcing.

The size of the actual resistive element 10, in a specific example given for purposes of illustration, not limitation, is about 0.680 inch long, having a width of 0.030 inch. The resistance of this specific example element is 10 ohms. In such specific example, the size of substrate 13 is 0.80 inch long by 0.50 inch high.

The line of resistive film, in the present example, is 0.0004 inch to 0.001 inch thick (fired thickness).

Proceeding next to a description of the terminal means 11 (FIG. 1), this may be a wide variety of terminals including (for example) terminals generally in line with the resistive element 10. It is not necessary that the terminals connect to the substrate 13 mechanically, but this is preferred for the present embodiment, which has solder attachment of the terminals.

Figure 3:
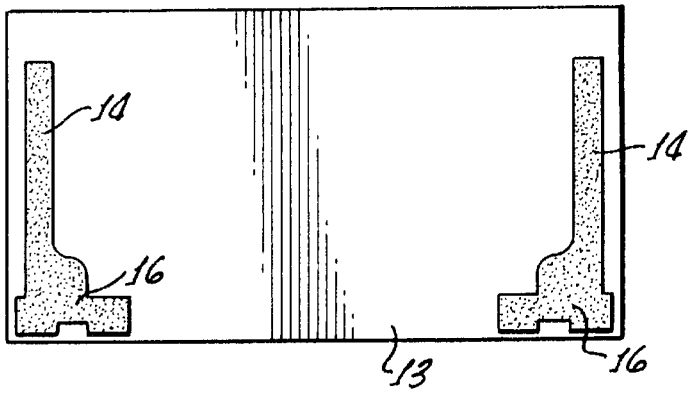
FIG. 3 shows one side of the substrate, with only the traces and terminal pads thereon.

Referring to FIG. 3, the illustrated screen-printed traces 14 and pads 16 form part of the terminal means 11 (FIG. 1), being located adjacent the ends of substrate 13 with the traces generally parallel to the ends of the substrate. Traces 14 and pads 16 are simultaneously screenprinted of a low resistivity material, preferably having a resistivity less than 5 milliohms per square. An example of this is DuPont 9770. Such DuPont 9770 is a platinum-silver composition. After the terminal (termination) traces and pads are screen-deposited, and before the resistive element 10 is deposited there over, the traces and pads are fired. Similarly, after the preferred screen-printed resistive element 10 is deposited, it is fired.

The terminal means in the illustrated example include jaw-type terminal pins 17 that clamp on pads 16, 18 and are soldered thereon.

The pins 17 are prevented from heating excessively, not only by the high conductivity of the traces 14 and pads 16, but also because the resistive element 10 is spaced away from the lower edge of the substrate 13, being relatively near the upper edge thereof. Thus, there is a substantial thermal gradient between the heat-generating resistive element 10 and the pin portions that are in the circuit board holes. The thermal gradient is increased by thinness of the substrate.

It is emphasized that various other configurations may be employed, for example, making the substrate much less high so that the pins are quite close to the resistive film. A smaller part is thereby achieved, as may be done, for example, when the resistance of the resistive element 10 is only (for example) about 1 ohm, and there is lower power dissipation caused by normal currents.

Proceeding to a detailed description of the containing and sealing means 12 (FIG. 2), the illustrated preferred such means comprises the substrate 13 which therefore (in the preferred form) serves not only for application of the films but as part of the containing and sealing means. It further comprises a lid 19 (FIGS. 1 and 2) that is preferably positioned with its top and side margins registered with the upper and vertical margins of substrate 13 and with its lower edge 21 spaced from resistive element 10. An exemplary material forming the substrate 13 and lid 19 is aluminum oxide.

Elements 13, 19 may each have a thickness of 0.030 inch. When the pressures are higher, each is made 0.040 inch thick. Even these relatively thin layers, formed of brittle aluminum oxide (for example), will contain the pressures resulting from large current flows through resistive element 10.

The containing and sealing means 12 further comprises sealing and connecting material 22 (FIG. 2) that fills the entire space between the facing surfaces of elements 13, 19. The preferred such material is epoxy adhesive. Because it fills the entire space, except that space occupied by the films, there is substantially no air between the elements 13, 19 (there may be very small air bubbles in the epoxy).

In the preferred embodiment, prior to application of the lid and the terminals, the resistive element 10 is covered with an overglaze (glass layer) 23. This glass layer is preferably screen-printed and is then fired. An exemplary material is DuPont 9137. There are preferably two passes during screen-printing, using a 200 mesh screen, fired after each pass at 550° C. to a highly glassy finish.

As shown best in FIG. 6, glass layer 23 is substantially larger than resistive element 10 so that is extends substantially beyond the sides and ends of the resistive element. As a result of fault operation, the resistive element 10 increases in width by typically less than 10% along each side. There may be no increase in width.

The ceramic substrate and lid, the epoxy, and (preferably) the glass layer cooperate to form an effective containing and sealing means 12 that (as above stated) prevent explosion of the FCFR and prevent blowouts. There is no debris after the fuse opens, and the product is characterized by a high degree of safety.

Figure 2:
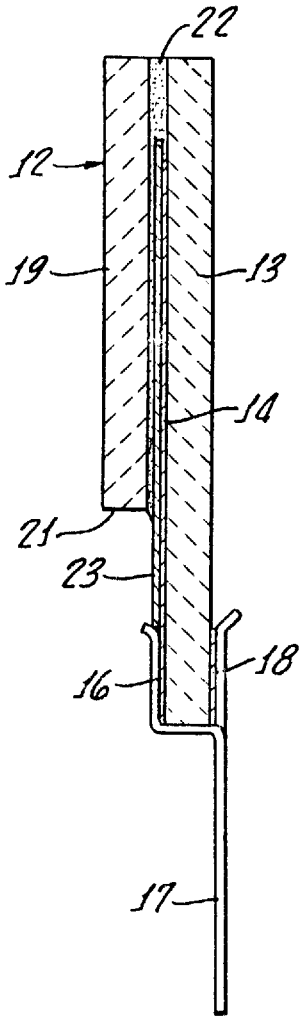
FIG. 2 is a further enlarged sectional view thereof, taken on line 2—2 of FIG. 1.

In another product that corresponds to the present one, except for size, the lower edge 21 of lid 19 is much lower than that illustrated in FIGS. 1 and 2, being adjacent the upper portions of the jaws of pins 17.

In performing the method of the invention, the present article or device (preferably the preferred form shown in the drawings and described in detail above) is mounted on a circuit board or otherwise connected in series relationship with the components or circuit board traces to be protected against short circuit current. Reference is made to FIG. 7. In the exemplary situation described at the beginning of this specification, this is a circuit for a power-semiconductor. Thus, in such exemplary situation, the present FCFR is connected in series with the potential short circuit current path of the power-semiconductor circuit.

Because of the presence of this invention, the harm and destruction are believed to be substantially completely prevented from occurring. Instead, what happens is that the fault current flowing through the resistive element causes breakdown of resistor conduction, which breakdown shuts off current in an extremely short time. There is a bright flash that is very clearly visible through the substrate 13. The distance between the upper ends of traces 14 is made sufficient, within the contained construction, to prevent resumption of current (restriking) despite continuation of the relatively high voltage that caused the device to open.

The above-specified specific-example article (10 ohms), at 1,000 volts DC and potentially 100 amps, shuts off the current in less than 200 microseconds—with the great majority of the current reduction occurring in the first 20 microseconds.

Because of the present invention, it is possible to build a control circuit with relatively little board copper trace. Stated otherwise, there can be a minimum trace dimension on the board of the control circuit, because the fusing operation of the present invention is so very quick. The quickness and completeness of the shut-off are astonishing.

When no glass (overglaze) is employed, the margins of the affected area resulting from fault current operation expand considerably compared as to what is the case when the glass is employed.

As above indicated, the present invention includes (in one of its aspects) the combination of a power-semiconductor (and the control circuit associated therewith) with the present FCFR. In accordance with one aspect of the present method, the FCFR in the combination stated in the preceding sentence safely opens at voltages in the range of 150 volts to 1,000 volts AC/DC.

The present device should not have any portion of the resistive element that is not contained. Thus, for example, there should be no unlidded resistive element portion exposed on the backside (exposed side) of the base or substrate and which is in circuit with the lidded resistive element on the frontside.

Additional Discussion of Method and Article

The present FCFR method and article are characterized by results that far exceed any of which applicant has ever heard. For example, a practical size of the present FCFR can operate at 2000 volts DC during a fault condition, and clear within 50 micro seconds. This occurs safely, with no breakage or other undesired consequence. It is only a flash of light that is an exteriorly visible consequence of the fault.

Applicant is unsure of much of the theory that relates to the surprising phenomena occurring in the present FCFR during a fault. There will now be indicated (1) those elements that applicant believes are important to achievement of the results stated in this specification, and (2) the condition of the resistive element after the fault has occurred.

The above-recited palladium-silver Ferro 850 contains palladium and silver and glass. These are present in powder (particle) form, in a suitable vehicle that is present during application to the substrate (as by screen printing) but is driven off by the firing. The palladium-silver Ferro 850 is an example of the distinctly preferred form of the present invention, namely certain metal and glass particles (powder) mixed with each other. After firing, the particles of metal are combined with glass in a conductive film. The majority of said film, by weight, is metal particles.

The second element indicated in the paragraph before last is close containment or encapsulation of the resistive element (such as 10). In the stated example, the substrate 13, the lid 19, the sealing and connecting material 22 and (in one form) overglaze 23 accomplish containment in a practical and economical manner. In the absence of containment, there would be an external "fire ball" during the high-current fault condition at high voltage. It is to be understood that effective close containment involves exclusion of substantial air and elimination of substantial voids; air is not desired at or near the resistive element (such as 10) because electric arcing is to be prevented to the maximum extent reasonable.

Another factor significant in achievement of optimum results is that the resistive line (such as 10) be quite thin. Thus, typically, a 325 or 400 mesh screen is used in the screen-printing operation. The film after firing is then about 0.0005 inch thick. When a 200 mesh screen is used the results are less satisfactory.

The particles of metal in the resistive film 10 are small. Exemplary such particles are about 1 micrometer in size.

Much less preferably, the metal is provided as a very thin conductive film but without glass included in the conductive film.

Proceeding to a description of the resistive film (such as 10) after the fault, this is determined by first removing the lid 19, epoxy 22 and overglaze 23. Examination by microscope of the resistive film (line) 10 thus exposed reveals the presence of many interruptions, breaks, or discontinuities in the resistive film (line) 10 and extending generally perpendicular to the longitudinal axis of the film (line). The number of such breaks is, applicant believes, related to the magnitude of the voltage present across the FCFR during continuance of the fault. The breaks are spaced from each other longitudinally of the film (line).

For example, in one FCFR of 10 ohm resistance, there were 63 breaks in 0.68 inch of film (line) 10, when the voltage present during the fault was 1000 volts. Higher voltage would produce more breaks; less-high voltage would result in less breaks.

Typically, each such break (interruption or discontinuity) is about 0.0005 inch to 0.003 inch wide. These breaks are usually not empty; they contain some residue and also some metal balls or spheres. They also contain some glass, which may be dissolved out by acid in order that the metal may be better seen.

The breaks may present the appearance of aerial photos of large rivers, in which there are islands and channels—the "river" edges (banks) being not straight but irregular. The "rivers" extend substantially the entire distance (0.030 inch in the above-stated example) across the resistive element (such as resistive line 10). The metal balls give the appearance, from above, of very large balloons that are hovering over the "rivers"—typically at their "banks". The balls have a variety of sizes.

The breaks (or series thereof) give the appearance of having been produced by pulling the resistive film or line apart, by tensile forces that are longitudinal to the line.

Applicant has several theories to explain the stated phenomena. But despite (for example) examinations of the parts using an electron microscopes, most "explanations" are in large part speculations. There are some things that appear quite evident:

(1) Some metal in the breaks becomes molten, because it draws up into the balls or spheres (probably by surface tension).

(2) As above stated, the higher the voltage the greater the number of breaks. The multi-break fault condition is to be sharply contrasted with what occurs in conventional all-metal (wire, or metal section) fuses. There, there is typically only one break, and it becomes larger and larger. It is not known whether the breaks in the present device occur simultaneously or in cascade.

(3) The close containment contains vapor resulting from heating of the conductive film, and/or may constrain molten metal as it tends to grow into larger balls. One or both of any such effects may tend to prevent or extinguish arcs or excessive break-growth.

(4) The flash of light appears to occur along a length of the fuse resistor—not only at one point.

(5) The fault current clears so fast that the containing structure does not explode or break.

(6) The fault current clears so fast that the top surface of the overglaze is not normally melted or affected (only sometimes slightly "freckled").

(7) The present phenomena are not the result of solution (dissolving) of the metal in the glass. Solution is not desired, though some may be tolerated.

(8) Because there are many breaks, the amount of voltage drop across each break is greatly reduced. There is something like a voltage-divider action.

(9) Any arcing is readily contained and extinguished.

(10) The preferred resistance range, stated above, provides the significant benefit of limiting the magnitude of the fault current just before clearing.

Embodiment of FIG. 8

Except as specifically stated, the embodiment of FIG. 8 is identical to that described above and exemplified below in the specific examples.

In this embodiment, the resistive line (film) 10 is usually not covered by the overglaze 23, although it may be so covered.

The lid 19 is not present, nor is the sealing and connecting material (epoxy) 22 present.

There is provided over the resistive line 10, after firing of such line, a chemically-bonded ceramic substance 26 having sufficient thickness that it will not blow out during a fault condition but will instead contain the pressure resulting from the heating and fusing caused by the high current.

As an example, the preferred form of the substance 26 may be about 0.03 inch thick. However, with some resistive line compositions the thickness is made 0.040 inch–0.060 inch, to prevent blowout.

Substance 26 is applied in paste form by a syringe and then allowed to air dry. It is then baked and cured. For example, it may (after air drying) be baked at 200° F. for 3 hours, then cured at 300° F. for one hour. It adheres very tightly to the substrate.

A preferred such ceramic substance 26 is "Cerama-Dip 538", which is a dielectric coating used for embedding high-temperature resistance wires, etc. Its major constituent is alumina. It is sold by Aremco Products, Inc., of Ossining, N.Y.

Embodiment of FIGS. 9–14

One of the advantages of the present simple and economical FCFR is that it may be packaged in ways desired by the electronics industry. Thus, for example, it may be packaged as a heatsink-mount device, or a radial lead device, or an axial lead device, or a surface mount device. These devices may have standard physical sizes and footprints.

Parts in FIGS. 9–14 that correspond to those in FIGS. 1–8, are given the same reference numeral but followed by "a". The substrate 13*a* corresponds to substrate 13 except that it is vertically somewhat elongate. Low resistivity traces 14*a* and pads 16*a* are screen-printed thereon and then fired. Then, resistive film (line) 10*a* is screen-printed thereon and fired. Overglaze 23*a* is screen-printed there over and fired.

Then, leads or pins 28 are soldered to the pads 16*a*, and extend parallel to each other outwardly from the substrate 13*a*. Lid 19*a* (FIG. 13) is then applied by the containing and sealing material (epoxy). Or, ceramic (such as 26) is used.

Figure 13:
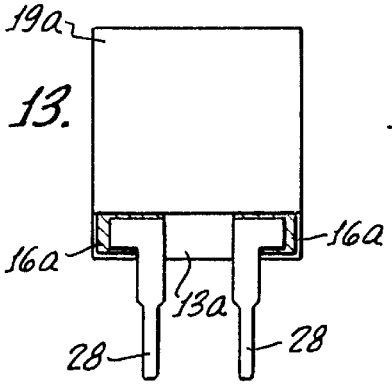
Figure 14:
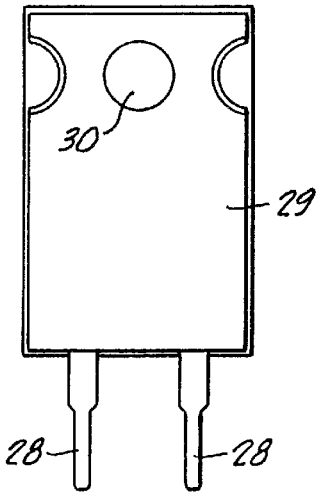

A molded package or body 29 (FIG. 14) of synthetic resin is then formed around the assembly shown in FIG. 13, by transfer molding or injection molding. The illustrated package 29 has a bolt hole 30 therethrough, so that the device is used as a heatsink-mount device.

Figure 15:
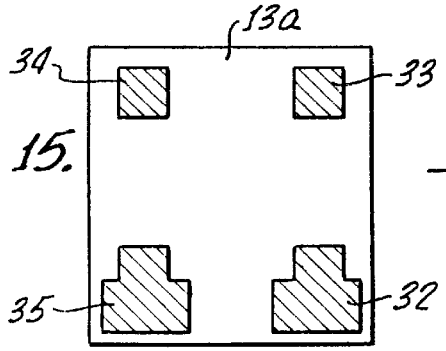
FIGS. 15–16 are front elevational views showing a further embodiment.
Figure 16:
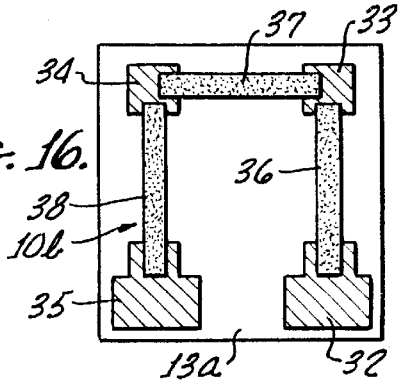

Embodiment of FIGS. 15–16

In accordance with the present embodiment, the resistive film (line) 10*b* corresponds to lines 10 and 10*a* in composition, etc., but is different in major ways. It is not continuous but segmented. The segments are connected together by low-resistivity pads corresponding in composition to pads (and traces) 14–16 and 14*a*–16*a*.

In the illustrated form there are four pads 32, 33, 34 and 35 at the corner portion of substrate 13*a* (which is the same as the substrate in the previous embodiment).

Sections 36, 37 and 38 of the resistive film (line) connect respectively between pads 32-33, 33-34, and 34-35. Except for length and orientation, sections 36, 37 and 38 are each identical to resistive film 10.

The illustrated sections 36, 37 and 38 are at right angles to each other. Their combined lengths are much longer than (for example) the length of line 10*a* in FIG. 10. Accordingly, the embodiment of FIGS. 15–16 can withstand a higher voltage, after the fault condition ends, than can the embodiment of FIGS. 9–14. The fault voltage drop is distributed along the film line—more specifically along the breaks in such line—so that the longer line provides better isolation of higher fault voltages.

The low-resistivity corner pads 33,34 reduce the chances that there will be arcing at the corners, or that there will be undesirably large breaks at the corners. No large break is desired; what are wanted are a multiplicity of small breaks such as were described relative to the first embodiment.

The device of FIGS. 15–16 is completed by following the steps shown and described relative to FIGS. 11, 12, 13 and 14. The result is a high-voltage FCFR, that is small and shaped and packaged as desired, at that clears high currents with amazing speed.

Additional specific examples are described in APPENDIX A at the end of this specification.

The word "glass" as used in the appended claims includes not only the conventional meaning of that word, but also any ceramic substances having a capability of forming during firing a glass-like matrix in the conductive film, which glass-like matrix functions equivalently to glass so as to achieve the multiple breaks described in detail above. It is also to be understood that under some conditions glass may be "made" during firing from glass-forming ingredients in the deposited material. The glass material may contain reinforcing fillers. The word "metal", as used in the appended claims, may include also some conductive metal oxides employed together with the metallic metal.

The foregoing detailed description is to be clearly understood as given by way of illustration and example only, the spirit and scope of this invention being limited solely by the appended claims.

APPENDIX A

ADDITIONAL SPECIFIC EXAMPLES

MATERIAL USED IN THE CONSTRUCTION OF FCFR TEST GROUPS

Substrate: 96% $AL_2O_3$ (Alumina) flat substrate was used in all versions tested Termination: Frontside and where applicable backside terminations.

DuPont 9770 Conductor Composition. Very low resistivity approx. 3 milliohm per square. The resistivity and/or the dimensions of the termination design give a low termination resistance relative to the FCFR element to avoid excessive heating and failure of the termination traces during the Fault current fusing of the element. 250 mesh (backside and frontside). Fired at 850° C. according to common thick film firing practices.

FCFR Element Material A: Ferro 850 Series formula No. 1/5.

Palladium Silver Composition. Resistivity is specified by Ferro as 1/5 Ω per square, (0.20 Ω per square) when deposited with 200 mesh screen and fired at 850° C.

The material is composed of metal powders, ceramic powders, and organic vehicle. The composition is composed of (by weight):

Palladium 15% to 75%. Approximately 1 μm in size.

Silver 10% to 50%. Approximately 1 μm in size.

Barium borosilicate glass 5% to 30%. Approximately 1 μm in size.

The glass melts in the region of about 700° C. to 800° C.

Vehicle 8% to 25%.

The organic vehicle provides for the suspension of the particles and the flow characteristics necessary for thick film screen printing. To form FCFR device resistance element this material is screeni printed with preferably a 325 mesh screen, more preferably a 400 mesh screen to give a thin deposit. After screen printing the material is dried at 100° C. for 15 minutes. The material is then fired in the range of 800° C. to 900° C. using a 60 minute firing profile with about 10 minutes at peak temperature. The firing process causes a clean burn-out and removal of the organic vehicle components leaving the metal and glass particles. This happening at the lower temperatures during the initial phase of the firing. At the high temperature of the firing process, the glass melts bonding the metal particles in a conductive film and bonding the element to the ceramic substrate and in electrical contact with the terminations. This is consistent with standard thick film processing.

Fault Current Fuse Resistor Element Material B: DuPont 9596

Platinum Gold. The material is composed of metal powders, glass and/or ceramic ingredients, and organic vehicle components. The materials are as follows as given by DuPont (by weight):

Gold metallic powder 30% to 60%

Platinum metallic powder 10% to 30%

Palladium metallic powder 1% to 5%

Glass or ceramic ingredients 10% to 30%

Vehicle 10% to 30%

The organic vehicle provides for the suspension of the particles and the flow characteristics necessary for thick film screen printing. To form FCFR device resistance element this material is screen printed with preferably a 325 mesh screen, more preferably a 400 mesh screen to give a thin deposit. After screen printing the material is dried at 100° C. for 15 minutes. The material is then fired in the range of 800° C. to 900° C. using a 60 minute firing profile with about 10 minutes at peak temperature. The firing process causes a clean burn-out and removal of the organic vehicle components leaving the metal and glass particles. This happening at the lower temperatures during the initial phase of the firing. At the high temperature of the firing process, the glass melts bonding the metal particles in a conductive film and bonding the element to the ceramic substrate and in electrical contact with the terminations. This is consistent with standard thick film processing.

FCFR Element Material C:

Caddock PH-DC Palladium Composition.

The material is composed of metal powders, glass and/or glass forming ingredients, and organic vehicle. The materials are as follows (by weight)

Palladium metallic powder, 75% to 80%, approximately 1 μm in size.

Glass and/or Ceramic powders,10% to 12%, approximately 1 μm in size.

The glass melts in the region of 700° C. to 800° C.

Vehicle 11% to 14%.

The organic vehicle provides for the suspension of the particles and the flow characteristics necessary for thick film screen printing. To form FCFR device resistance Clement this material is screen printed with preferably a 325 mesh screen, more preferably a 400 mesh screen to give a thin deposit. After screen printing the material is dried at 100° C. for 15 minutes. The material is then fired in the range of 850° C. to 900° C. using a 60 minute firing profile with about 10 minutes at peak temperature. The firing process causes a clean burn-out and removal of the organic vehicle components leaving the metal and glass particles. This happening at the lower temperatures during the initial phase of the firing. At the high temperature of the firing process, the glass melts bonding the metal particles in a conductive film and bonding the element to the ceramic substrate and in electrical contact with the terminations. This is consistent with standard thick film processing.

FCFR Element Material D:

DuPont 9770 Platinum Silver Composition. Resistivity approximately 3 milliohm/square when deposited with a 200 mesh screen and fired at 850° C.

The material is composed of metal powders, glass and/or glass forming ingredients, and organic vehicle. The materials are as follows as given by DuPont (by weight):

Silver metallic powder greater than 60%.

Platinum 0.1% to 1%.

Glass and/or glass forming ingredients 0.2% to 2%.

Copper Oxide 0.1% to 1%.

Copper metallic powder less than 0.1%

Vehicle 12% to 25%.

The organic vehicle provides for the suspension of the particles and the flow characteristics necessary for thick film screen printing. To form FCFR device resistance element this material is screen printed with preferably a 325 mesh screen, more preferably a 400 mesh screen to give a thin deposit. After screen printing the material is dried at 100° C. for 15 minutes. The material is then fired in the range of 850° C. to 900° C. using a 60 minute firing profile with about 10 minutes at peak temperature. The firing process causes a clean burn-out and removal of the organic vehicle components leaving the metal and glass particles. This happening at the lower temperatures during the initial phase of the firing. At the high temperature of the firing process, the glass and glass forming material melts bonding the metal particles in a conductive film and bonding the element to the ceramic substrate and in electrical contact with the terminations. Bonding is enhanced by the chemical bonding of the copper components with the alumina substrate. This is consistent with standard thick film processing.

Overglaze: DuPont 9137, green glass. Deposited by screen printing with 105 mesh screen or more preferably 2 screen printing passes of 200 mesh for eliminating pin holes to achieve the most reliable clearing (high blown resistance). Fire after each printing pass at 550° C. to a highly glassy finish.

Ceramic Lid with Epoxy fill: $AL_2O_3$ Flat ceramic piece is the positioned to cover the element. Epoxy is Emerson & Cuming product Eccobond 27. Epoxy is dispensed along the edge of the lid adjacent to the terminals at the substrate lid interface. By capillary action the epoxy is drawn in to fill between the ceramic lid and ceramic substrate, eliminating substantially all the air. The assembly is cured by a time and oven process.

Ceramic Coating: Aremco Product Ceramic Dip 538 Alumina based paste is thinned to the point that it is self leveling after dispensing. It is then applied by syringe over the element area with sufficient overlap and thickness (about 0.040 inches) to provide the required strength, and cured by time and oven process as stated in the patent specification.

Test group A:

Construction is as shown in FIG. 1 through FIG. 6:

Frontside Terminations: DuPont 9770, 325 mesh deposit.

Backside Terminations: DuPont 9770, 250 mesh deposit.

FCFR Element Size: 0.030 inch by 0.680 inch.

FCFR Element: Resistance value 10 Ω, Material A Ferro 850—1/5, 400 mesh deposit, 800° C. Firing.

Overglaze: 2 layers, 200 mesh deposits.

Encapsulation of element area: Ceramic lid with epoxy fill.

Fault Current Fuse Resistor Performance. Initial Resistance 10 Ω±10%.

| Sample: | Fault Voltage: | Results |
|---|---|---|
| Group A No. 1 | 250 Volts DC Potentially 25 Amps | Opens - clears to greater than about 50 MegΩ measured at 250 VDC<br>Time: About 200 μs to about 90% clear<br>About 800 μs to about 100% clear.<br>Breaks in the element - 4 breaks |
| Group A No. 2 | 500 Volts DC Potentially 50 Amps | Opens - clears to greater than about 100 MegΩ measured at 500 VDC<br>Time: About 70 μs to about 90% clear<br>About 300 μs to about 100% clear.<br>Breaks in the element - 23 breaks |
| Group A No. 3 | 1000 Volts DC Potentially 100 Amps | Opens - clears to greater than about 1,000 MegΩ measured at 1,000 VDC<br>Time: About 20 μs to about 90% clear<br>About 200 μs to about 100% clear.<br>Breaks in the element - 63 breaks |
| Group A No. 4 | 1500 Volts DC Potentially 150 Amps | Opens - clears to greater than about 10,000 MegΩ measured at 1,000 VDC<br>Time: About 20 μs to about 90% clear<br>About 100 μs to about 100% clear.<br>Breaks in the element - 89 breaks |

Test Group B:

Construction is as shown in FIG. 3 through FIG. 6 with ceramic coat encapsulation except substrate is larger and element is slightly longer.

Substrate size: 1.050 inch by 0.630 inch by 0.040 inch.

Frontside Terminations: DuPont 9770, 325 mesh deposit.

Backside Terminations: DuPont 9770, 250 mesh deposit.

FCFR Element Size: 0.030 inch by 0.790 inch.

FCFR Element: Resistance value 10 Ω, Material A Ferro 850—1/5, 400 mesh deposit, 800° C. firing.

Overglaze: 2 layers, 200 mesh deposits.

Encapsulation of element area: Ceramic coating.

Fault Current Fuse Resistor Performance. Initial Resistance 10 Ω±10%.

| Sample: | Fault Voltage: | Results: |
|---|---|---|
| Group B No. 1 | 500 Volts DC Potentially 50 Amps | Opens - clears to greater than about 10 MegΩ measured at 500 VDC<br>Time: About 100 μs to about 90% clear<br>About 300 μs to about 100% clear. |
| Group B No. 2 | 1000 Volts DC Potentially 100 Amps | Opens - clears to greater than about 10 MegΩ measured at 1,000 VDC<br>Time: About 20 μs to about 90% clear<br>About 200 μs to about 100% clear. |
| Group B No. 3 | 1590 Volts DC Potentially 150 Amps | Opens - clears to greater than about 100 MegΩ measured at 1,000 VDC<br>Time: About 15 μs to about 90% clear<br>About 50 μs to about 100% clear. |

Figure 4:
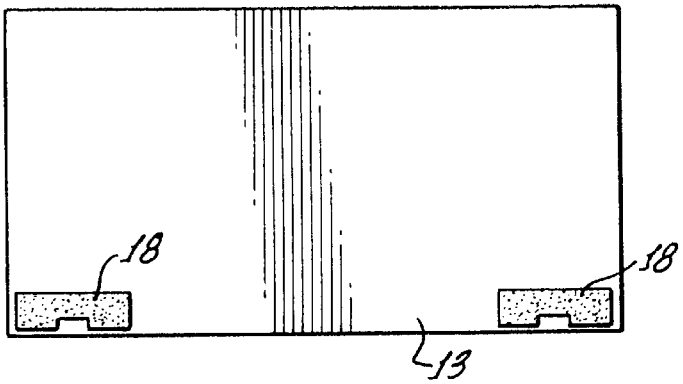
FIG. 4 is a rear view of FIGS. 3, 5 and 6, showing terminal pads.

Test Group C:

Construction is as shown in FIG. 3, FIG. 4, and FIG. 5. Except larger substrate and slightly larger element. There is no overglaze. This group has a ceramic coating as the encapsulation.

Substrate Size: 1.050 inch by 0.630 inch by 0.040 inch.

Frontside Terminations: DuPont 9770, 325 mesh deposit.

Backside Terminations: DuPont 9770, 250 mesh deposit.

FCFR Element Size: 0.030 inch by 0.790 inch.
FCFR Element: Resistance value 10 Ω, Material A Ferro 850—1/5, 400 mesh deposit, 800° C. firing.
Overglaze: None.
Encapsulation of element area: Ceramic coating.
Fault Current Fuse Resistor Performance. Initial Resistance 10 Ω±10%.

| Sample: | Fault Voltage: | Results: |
|---|---|---|
| Group C No. 1 | 500 Volts DC Potentially 50 Amps | Opens - clears to greater than about 3 MegΩ measured at 500 VDC<br>Time: About 70 μs to about 90% clear<br>About 300 μs to about 100% clear. |
| Group C No. 2 | 1000 Volts DC Potentially 100 Amps | Open - clears to greater than about 6 MegΩ measured at 1,000 VDC<br>Time: About 10 μs to about 90% clear<br>About 100 μs to about 100% clear. |
| Group C No. 3 | 1500 Volts DC Potentially 150 Amps | Opens - clears to greater than about 20 MegΩ measured at 1,000 VDC<br>Time: About 10 μs to about 90% clear<br>About 70 μs to about 100% clear. |

Test Group D:

Construction is as shown in FIG. 3 through FIG. 6 except 0.015 inch wide (vertical dimension) element with lid. And substrate size is larger and element is slightly larger.

Substrate Size: 1.050 inch by 0.630 inch by 0.040 inch.
Frontside Terminations: DuPont 9770, 325 mesh deposit.
Backside Terminations: DuPont 9770, 250 mesh deposit.
FCFR Element Size: 0.015 inch by 0.0790 inch.
FCFR Element: Resistance value 10 Ω, Material A Ferro 850—1/5, 400 mesh deposit, 800° C. firing.
Overglaze: 2 layers, 200 mesh deposits.
Encapsulation of element area: Ceramic lid with epoxy fill.
Fault Current Fuse Resistor Performance. Initial Resistance 18 Ω±10%.

| Sample: | Fault Voltage: | Results: |
|---|---|---|
| Group D No. 1 | 500 Volts DC Potentially 27.8 Amps | Opens - clears to greater than about 10,000 MegΩ measured at 500 VDC<br>Time: About 50 μs to about 90% clear<br>About 200 μs to about 100% clear.<br>Breaks in the element - 20 breaks |
| Group D No.2 | 1000 Volts DC Potentially 55.5 Amps | Opens - clears to greater than about 10,000 MegΩ measured at 1,000 VDC<br>Time: About 10 μs to about 90% clear<br>About 150 μs to about 100% clear.<br>Breaks in the element - 44 breaks |
| Group D No. 3 | 1500 Volts DC Potentially 83.3 Amps | Opens - clears to greater than about 10,000 MegΩ measured at 1,000 VDC<br>Time: About 10 μs to about 90% clear<br>About 100 μs to about 100% clear.<br>Breaks in the element - 71 breaks |
| Group D No. 4 | 2000 Volts DC Potentially 111.1 Amps | Opens - clears to greater than about 10,000 MegΩ measured at 1,000 VDC<br>Time: About 10 μs to about 90% clear<br>About 100 μs to about 100% clear.<br>Breaks in the element - 78 breaks |

Test Group E:

Construction is as shown in FIG. 3 through FIG. 6 except 0.015 inch wide (vertical dimension) element overglaze with ceramic coat encapsulation. And substrate size is larger and element is slightly larger.

Substrate Size: 1.050 inch by 0.630 inch by 0.040 inch.
Frontside Terminations: DuPont 9770, 325 mesh deposit.
Backside Terminations: DuPont 9770, 250 mesh deposit.
FCFR Element Size: 0.015 inch by 0.790 inch.
FCFR Element: Resistance value 7 Ω, Material B DuPont 9596, 400 mesh deposit 850° C. firing.
Overglaze: 2 layers, 200 mesh deposits.
Encapsulation of element area: Ceramic Coating.
Fault Current Fuse Resistor Performance. Initial Resistance 7 Ω±10%.

| Sample: | Fault Voltage: | Results: |
|---|---|---|
| Group E No. 1 | 500 Volts DC Potentially 71.4 Amps | Opens - clears to greater than about 10,000 MegΩ measured at 500 VDC<br>Time: About 50 μs to about 90% clear<br>About 200 μs to about 100% clear. |
| Group E No. 2 | 1000 Volts DC Potentially 142.9 Amps | Opens - clears to greater than about 10,000 MegΩ measured at 1,000 VDC<br>Time: About 10 μs to about 90% clear<br>About 100 μs to about 100% clear. |
| Group E No. 3 | 1500 Volts DC Potentially 214.3 Amps | Opens - clears to greater than about 10,000 MegΩ measured at 1,000 VDC<br>Time: About 10 μs to about 90% dear<br>About 100 μs to about 100% clear. |
| Group E No. 4 | 2000 Volts DC Potentially 285.7 Amps | Opens - clears to greater than about 10,000 MegΩ measured at 1,000 VDC<br>Time: About 10 μs to about 90% clear<br>About 100 μs to about 100% clear. |

Test Group F:

Construction is as shown in FIG. 1 through FIG. 6 except the substrate is larger and the element is slightly longer:

Substrate Size: 1.050 inch by 0.630 inch by 0.040 inch.
Frontside Terminations: DuPont 9770, 325 mesh deposit.
Backside Terminations: DuPont 9770, 250 mesh deposit.
FCFR Element Size: 0.030 inch by 0.790 inch.
FCFR Element: Resistance value 7 Ω, Material C Caddock PH-DC, 400 mesh deposit, 800° C. firing.
Overglaze: 2 layers, 200 mesh deposits.
Encapsulation of element area: Ceramic lid with epoxy fill.
Fault Current Fuse Resistor Performance. Initial Resistance 7 Ω±10%.

| Sample: | Fault Voltage: | Results: |
|---|---|---|
| Group F No. 1 | 500 Volts DC Potentially 71.4 Amps | Opens - clears to greater than about 10,000 MegΩ measured at 500 VDC<br>Time: About 50 μs to about 90% clear<br>About 200 μs to about 100% clear.<br>Breaks in the element - 22 breaks |
| Group F No. 2 | 1000 Volts DC Potentially 142.9 Amps | Opens - clears to greater than about 10,000 MegΩ measured at 1,000 VDC<br>Time: About 30 μs to about 90% clear<br>About 150 μs to about 100% clear.<br>Breaks in the element - 55 breaks |
| Group F No. 3 | 1500 Volts DC Potentially 214.3 Amps | Opens - clears to greater than about 10,000 MegΩ measured at 1,000 VDC<br>Time: About 20 μs to about 90% clear<br>About 100 μs to about 100% clear.<br>Breaks in the element - 86 breaks |
| Group F No. 4 | 2000 Volts DC Potentially 285.7 Amps | Opens - clears to greater than about 10,000 MegΩ measured at 1,000 VDC<br>Time: About 10 μs to about 90% clear<br>About 50 μs to about 100% clear.<br>Breaks in the element - much greater than 86 breaks |

Test Group G:

Construction is as shown in FIG. 3 through FIG. 6 except 0.015 inch wide (vertical dimension) element, overglaze and ceramic coat encapsulation. And substrate size is larger and element is slightly larger.

Substrate Size: 1.050 inch by 0.630 inch by 0.040 inch.

Frontside Terminations: DuPont 9770, 325 mesh deposit.

Backside Terminations: DuPont 9770, 250 mesh deposit.

FCFR Element Size: 0.015 inch by 0.790 inch.

FCFR Element: Resistance value 0.35 Ω, Material D DuPont 9770, 400 mesh deposit, 850° C. firing.

Overglaze: 2 layers, 200 mesh deposits.

Encapsulation of element area: Ceramic Coating, the coating thickness when cured must be greater than 0.040 inches.

Fault Current Fuse Resistor Performance. Initial Resistance 0.35 Ω±10%.

| Sample | Fault Voltage: | Results: |
|---|---|---|
| Group G No. 1 | 300 Volts DC Potentially 857 Amps | Opens - clears to greater than about 5,000 MegΩ measured at 300 VDC<br>Time: About 50 μs to about 90% clear<br>About 200 μs to about 100% clear. |
| Group G No. 2 | 500 Volts DC Potentially 1,428 Amps | Opens - clears to greater than about 5,000 MegΩ measured at 500 VDC<br>Time: About 30 μs to about 90% clear<br>About 300 μs to about 100% clear. |

-continued

| Sample | Fault Voltage: | Results: |
|---|---|---|
| Group G No. 3 | 1,000 Volts DC Potentially 2,857 Amps | Opens - clears to greater than about 5,000 MegΩ measured at 1,000 VDC<br>Time: About 5 μs to about 90% clear<br>About 300 μs to about 100% clear. |

What is claimed is:

1. A fault current fusing resistor, which comprises:

(a) a line of resistive film on a substrate, said line being sufficiently long that the fault current fusing resistor will extinguish an electrical fault current resulting from a fault voltage substantially in excess of 125 volts, and will maintain said fault current extinguished despite continued application of said fault voltage, said line being sufficiently short to prevent the resistance of said line from being excessively high and also sufficiently short for proper fault-fuse operation, (b) first and second terminal means connected, respectively, to opposite ends of said film, and (c) containing and sealing means provided closely around said film, and adapted to contain pressure that occurs upon sudden application to said terminal means and thus to said film of an electrical fault consisting of said fault current at said fault voltage, said substrate being part of said containing and sealing means, said containing and sealing means being sufficiently strong to withstand the forces related to the heating and opening of said resistive film caused by said fault current, characterized in that said elements (a), (b) and (c) are so constructed and related that said fault current ceases very rapidly, further characterized in that said film comprises particles of metal mixed with glass, further characterized in that no part of said line of film is outside of said containing and sealing means, and further characterized in that said fault current clears so fast that said containing and sealing means does not explode or break.

2. The invention as claimed in claim 1, in which said particles of metal in said film are palladium particles.

3. The invention as claimed in claim 1, in which said particles of metal in said film are palladium particles and silver particles.

4. The invention as claimed in claim 1, in which said particles of metal in said film are gold particles and platinum particles.

5. The invention as claimed in claim 1, in which said particles of metal in said film are silver particles and platinum particles.

6. The invention as claimed in claim 1, in which said film contains a majority by weight of metal particles, and a minority of glass.

7. The invention as claimed in claim 1, in which said containing and sealing means is a ceramic applied in paste form onto said substrate over said resistive film, in adherent relationship to said substrate and having sufficient thickness to contain said pressure and not blow out during electrical fault conditions.

8. The invention as claimed in claim 1, in which said containing and sealing means comprises an overglaze, and means to back up said overglaze and prevent vapor from blowing out during electrical fault conditions.

9. The invention as claimed in claim 1, in which said containing and sealing means comprises a ceramic applied in paste form.

10. The invention as claimed in claim 8, in which said means to back up said overglaze is a ceramic lid, and adhesive means to secure said lid to said substrate over said overglaze.

11. The invention as claimed in claim 1, in which said containing and sealing means comprises a ceramic lid, and adhesive means to secure said lid to said substrate over said resistive film.

12. The invention as claimed in any of claims 1–11, in which said resistive film has a thickness in the range about 0.0004 inch to about 0.001 inch.

13. The invention as claimed in any of claims 1–11, in which said line is divided into sections, said sections being electrically separated from each other by low-resistivity film, said low-resistivity film providing electrical connection between said sections.

14. The invention as claimed in any of claims 1–11, in which said line is divided into sections, said sections being electrically separated from each other by low-resistivity film, said low resistivity film providing electrical connection between said sections, said sections not being aligned with each other but instead being at substantial angles to each other, to thereby achieve a significant voltage-divider action in a small space.

15. The invention as claimed in any of claims 1–11, in which said resistive film line has a width in the range about 0.01 inch to about 0.03 inch.

16. A fault current fusing resistor, which comprises:

(a) a substrate, (b) an elongate resistive film provided on said substrate, and (c) terminals connected to opposite ends of said film, and (d) means associated with said film to prevent it from blowing out when a fault current condition occurs, characterized in that said elongate resistive film has such a composition and shape that upon happening of an electrical fault condition causing a fault current at a fault voltage, said resistive film clears by having many breaks formed therein transversely thereof and spaced longitudinally thereof.

17. The invention as claimed in claim 16, in which said elongate resistive film has such a composition and shape that upon said happening of a fault current condition at a first voltage said resistive film clears by having many of said breaks, and upon happening, in a second and identical fault current fusing resistor, of a fault current condition at a voltage markedly higher than said first voltage said resistive film in such second resistor clears by having a number of said breaks much greater than said many breaks.

18. The invention as claimed in any of claims 1–11 or 16–17, in which said fault current fusing resistor is connected to and combined with a circuit portion to be protected from short circuits and other electrical faults.

19. A fault current fusing resistor, which comprises:

(a) a substrate that is sufficiently thick to prevent vapor from blowing therethrough, during an electrical fault condition, from the resistive film recited below, (b) a single line of resistive fuse film provided on said substrate, said line comprising metal particles, and (c) means to closely confine and seal said line of film to prevent escape of said vapor, characterized in that said substrate (a) and said confining means (c) do not break during an electrical fault condition, further characterized in that said line of resistive film is narrow and thin, and has an electrical resistance less that 30 ohms, and further characterized in that said line of film and said confining and sealing means are such that during an electrical fault condition there is a visible flash of light along a length of said line not only at one point.

20. A fault current fusing resistor, which comprises:

(a) a substrate that is sufficiently thick to prevent vapor from blowing therethrough, during an electrical fault condition, from the resistive film recited below, (b) a single line of resistive film provided on said substrate, said line comprising metal particles, and (c) means to confine and seal said line of film to prevent escape of said vapor, said film being so selected that upon occurrence of a fault the fault current flow through said line of film ceases extremely rapidly, and there are formed in said line of film a plurality of breaks that extend transversely of said line of film and that are spaced longitudinally of said line.

21. A fault fuse, which comprises:

(a) a line of electrically resistive fuse film, (b) terminal means connecting to said line of film at opposite end portions thereof, and (c) containing and sealing means provided around all of said line of film between said terminal means to closely confine and seal said line of film, said containing and sealing means having such construction and composition that said containing and sealing means remains intact and unbroken and prevents blowouts during and after occurrence of an electrical fault having sufficient magnitude to cause the below-stated fusing action, said line of film being so selected that upon occurrence of said fault the fault current flow through said line of film ceases extremely rapidly, and there are formed in said line of film many breaks that extend transversely of said line of film and that are spaced longitudinally along said line of film.

22. The invention as claimed in claim 21, in which said line of film is less than one inch in length.

23. The invention as claimed in claim 21, in which said line of film has a width of about 0.01 inch to about 0.03 inch.

24. The invention as claimed in claim 21, in which said line of film is less than one inch in length and has a width of about 0.01 inch to about 0.03 inch.

25. The invention as claimed in claim 21, in which said film has a thickness of about 0.0004 inch to about 0.001 inch.

26. The invention as claimed in claim 21, in which said line of film is less than one inch in length, and has a width of about 0.01 inch to about 0.03 inch, and has a thickness of about 0.0004 inch to about 0.001 inch.

27. The invention as claimed in claim 21, in which said line of film is substantially straight.

28. The invention as claimed in claim 21, in which said line of film does not bend back on itself, and does not have portions that are laterally adjacent each other.

29. The invention as claimed in claim 21, in which said containing and sealing means includes a layer of glass over which is provided a layer that is much stronger than said layer of glass and that confines said glass and said line of film.

30. The invention as claimed in claim 21, in which said line of film has a resistance of more than a few milliohms.

31. The invention as claimed in claim 29, in which said line of film has a resistance in the range of 0.5 ohm to 30 ohms.

32. The invention as claimed in any of claims 21–31, in which said film is resistive and contains a majority by weight of metal particles, and a minority of glass.

33. The invention as claimed in claim 1, in which said line of resistive film is narrow.

34. The invention as claimed in claim 1, in which said line of resistive film has an electrical resistance under 30 ohms.

35. The invention as claimed in claim 1, in which said line of resistive film has an electrical resistance in the range of about 0.5 ohm to 10 ohms.

36. The invention as claimed in claim 1, in which said line of resistive film has such a shape that it progresses forwardly and does not double back.

37. The invention as claimed in claim 1, in which said substrate is about 0.80 inch long.

38. The invention as claimed in claim 1, in which said line of resistive film is narrow and in which said line of resistive film has an electrical resistance under 30 ohms.

39. The invention as claimed in claim 1, in which the length of said line of film is less than 1 inch.

40. The invention as claimed in claim 1, in which the length of said line of film is less than 1 inch and in which said line of resistive film is narrow.

41. The invention as claimed in claim 1, in which the length of said line of film is less than 1 inch, in which said line of resistive film is narrow, and in which said line of resistive film has an electrical resistance under 30 ohms.

42. The invention as claimed in claim 1, in which said fault voltage substantially in excess of 125 volts is about 250 volts.

43. The invention as claimed in claim 1, in which said fault voltage substantially in excess of 125 volts is about 500 volts.

44. The invention as claimed in claim 1, in which said fault voltage substantially in excess of 125 volts is about 1,000 volts.

45. The invention as claimed in claim 1, in which said fault voltage substantially in excess of 125 volts is about 1,500 volts.

46. The invention as claimed in claim 1, in which said fault voltage substantially in excess of 125 volts is about 2,000 volts.

* * * * *

UNITED STATES PATENT AND TRADEMARK OFFICE

CERTIFICATE OF CORRECTION

PATENT NO. : 5,914,648

DATED : June 22, 1999

INVENTOR(S) : Richard E. Caddock, Jr.

It is certified that error appears in the above-identified patent and that said Letters Patent is hereby corrected as shown below:

Column 4, line 63, between the words "that" and "extends" delete the word "is" and insert therefor the word --it--.

Column 9, line 2, between the words "desired," and "that" delete the word "at" and insert between the words "clears" and "high" the word --at--.

Column 13, line 37, between the words "by" and "inch" delete the term "0.0790" and insert therefor the term --0.790--.

UNITED STATES PATENT AND TRADEMARK OFFICE

CERTIFICATE OF CORRECTION

PATENT NO. : 5,914,648

DATED : June 22, 1999

INVENTOR(S) : Richard E. Caddock, Jr.

It is certified that error appears in the above-identified patent and that said Letters Patent is hereby corrected as shown below:

Column 13, line 38, between the word "value" and the term "Ω" delete the term "10" and insert therefor the term --18--.

Column 14, line 14, between the words "element" and "overglaze" please add a --,-- (comma).

Column 18, line 5, claim 19, between the words "less" and the term "30 ohms" delete the word "that" and insert therefor the word --than--.

Signed and Sealed this

Eighteenth Day of July, 2000

*Attest:*

Q. TODD DICKINSON

*Attesting Officer*

*Director of Patents and Trademarks*